United States Patent [19]

Slack et al.

[11] Patent Number: 4,754,253

[45] Date of Patent: Jun. 28, 1988

[54] ADJUSTABLE TEMPERATURE THERMOSTAT

[75] Inventors: Douglas J. Slack, Smithfield Plains; Wayne S. Dogan, Glengowrie, both of Australia

[73] Assignee: Texas Instruments Incorporated, Dallas, Tex.

[21] Appl. No.: 924,727

[22] Filed: Oct. 29, 1986

[51] Int. Cl.[4] ..... H01H 337/12; H01H 337/46

[52] U.S. Cl. ..... 337/392; 337/382; 337/391

[58] Field of Search ..... 337/390, 389, 388, 391, 337/392, 131, 382, 397

[56] References Cited

U.S. PATENT DOCUMENTS 2,793,270 5/1957 Burch et al. ..... 337/397

4,166,995 9/1979 Pecker et al. ..... 337/390

*Primary Examiner*—Harold Broome

*Attorney, Agent, or Firm*—John A. Haug; Pat McAndrews; Melvin Sharp

[57] ABSTRACT

A thermostatic switch is shown having a body supporting a temperature sensing probe formed of a rod of one thermal coefficient of expansion connected to a channel of a different thermal coefficient of expansion. The difference in expansion between the rod channel is translated through a hinge to an overbalance type switch mounted on the body. The temperature at which the switch actuates is adjustable through an element movable toward and away from the switch by a cam mechanism as well as an independent threaded adjustment. The switch is shown in one embodiment as having an integral movable switch arm and loading spring and in a second embodiment as having a discrete movable switch arm and a discrete loading spring.

11 Claims, 3 Drawing Sheets

ADJUSTABLE TEMPERATURE THERMOSTAT

BACKGROUND OF THE INVENTION

This invention relates to an adjustable temperature thermostat and in particular it relates to a thermostat of the general type defined in U.S. Pat. No. 3,166,995, assigned to the assignee of the instant invention. In that patent a temperature sensing probe consist of a hollow tube fitted to extend from a support body and has within it a low expansion rod arranged so that in response to a change in temperature the differential expansion between the hollow tube and the rod actuates a snap action switch to open or close a circuit according to a set temperature. The particular snap action switch comprises blades loaded to give an overbalancing action and is supported from a bracket by ceramic insulators on which the blades of the switch are supported. This structure involves a relatively difficult assembly task because of the particular mounting of the probe and snap action switch. The present invention however need not be limited to that type of apparatus and can apply to a switch having a rod type of switch as in frypans.

SUMMARY OF THE INVENTION

The object of the present invention is to provide a simpler and more effective assembly which will be readily fabricated and will have ease of assembly due to the elimination of the bracket and ceramic insulators which support the switch blades. It is also an object of the invention to provide a highly effective method of adjusting the temperature at which the switch is actuated. A further object is to provide an assembly in which the thermostat can be readily calibrated to be actuated within preset conditions. Yet another object is the provision of an improved yet lower cost switch. Other objects may be had by referring to the following description and claims, taken in conjunction with the accompanying drawings.

The device according to this invention comprises a hollow body of insulating material having a cover or matching body half extending over the cavity or hollow on one side of the body and having projecting from the other side of the body temperature adjustment means and having within the hollow of the body the switch, preferably a snap action switch although it could be a "creep" switch, coupled to be actuated by the sensing members and itself having the blades supported directly from the body of insulating material to form effective support means for the switch. The probe assembly comprises a channel shaped member extending outwardly from one end of the body of insulating material with a rod of low expansion material being supported within the open channel. The rod is fixed at the outer end to the channel on the neutral axis of the channel. The assembly is arranged to actuate a hinge member formed integrally with the channel shaped probe member within the hollow body which actuates in turn the snap action switch through an insulator which isolates the switch from the probe, the function of the probe being to actuate the overbalancing snap action switch, or to actuate any other type of switch, at a preset temperature. A closed channel can, however, be used and this could be of circular cross-section.

An alternative embodiment of the switch employs a discrete spring element riveted to a conductive plate frame by the movable contact to provide optimum switch loading at reduced material cost.

BRIEF DESCRIPTION OF THE DRAWINGS

In order however that the invention will be fully appreciated an embodiment of same will now be described with reference to the accompanying drawings in which preferred embodiments are shown and in which.

Figure 1:
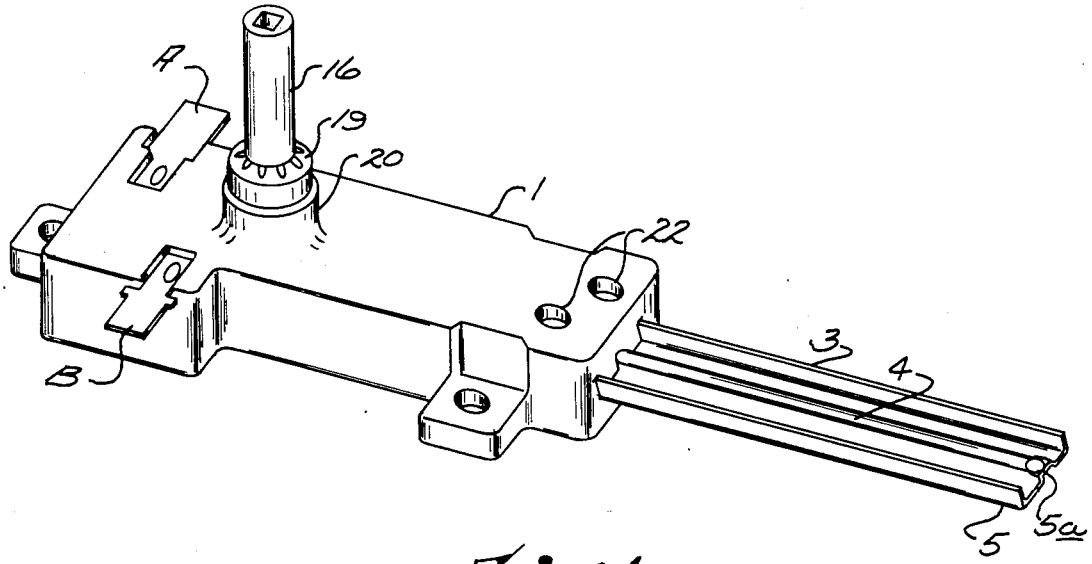
FIG. 1 is a perspective view of the adjustable temperature thermostat constructed according to this invention.

The body 1 preferably formed of plastic molded material has in it a cavity or hollow 2 and carriers at one end channel shaped heat sensing probe member 3. Within this open channel probe member 3*a* rod 4 is disposed fixed at the outer end 5 to channel shaped probe member 3 and these two members are connected to a hinge member 6 formed as a lever integral with the channel section of probe 3, so arranged that this lever member has its free end 7 move in accordance with the response of the channel shaped probe member 3 and the rod 4, to the sensed temperature.

Figure 3:
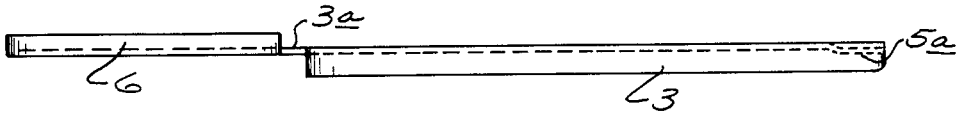
FIG. 3 is a slightly enlarged front elevational of the channel shaped probe in the orientation shown in FIG. 2.
Figure 4:
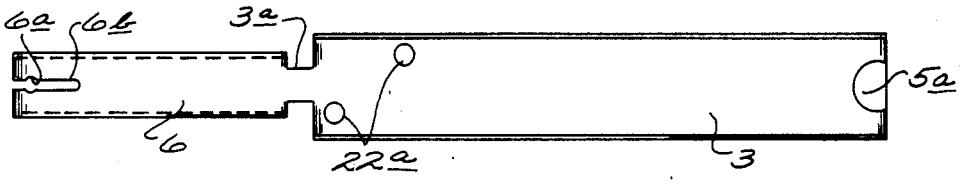
FIG. 4 is a bottom plan view of the probe of FIG. 2.
Figure 5:
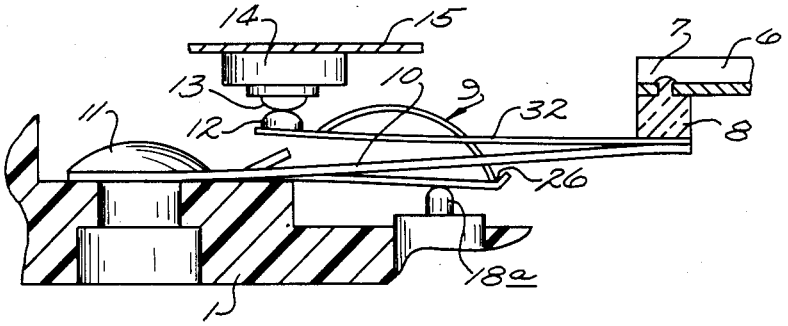
FIG. 5 is a partial sectional view of the snap acting switch portion of the thermostat.

The hinge member 6 and channel 3 are both formed out of a single piece of material such as stainless steel, as best seen in FIGS. 3 and 4. Hinge member 6 is also formed in a channel configuration with portion 3*a* intermediate member 6 and channel 3 being flat and having a reduced width to allow bending of hinge member 6. Channel 3 is provided with apertures 22*a* which are adapted to received therethrough rivets 22 (FIG. 1) to fix the probe to body 1.

Rod 4 is welded to the outer end 5 of channel 3 on a platform 5*a* of the channel's outer end 5 to locate the rod on the neutral axis of channel 3 to eliminate any bending of channel 3 when the probe assembly is stressed.

Movement of the hinge member 6 is transmitted through an insulator 8 which serves as a motion transfer member between the hinge member 6 and the appropriate blade of the snap action switch 9 as well as electrically isolating one from the other. Channel member 6 is formed with a slot 6*b* to define spaced legs at an end thereof and is adapted to received protrusion 8*a* of insulator 8 in cut out portion 6*a*, the cut out portion being slightly smaller than the protrusion so that the legs are biased apart to firmly grip protrusion 8*a*. Switch 9 takes the form described in the patent referred to supra with the exception in that switch blade 10 which forms the support means of the snap action switch is connected directly to the body 1 of insulating material by a rivet 11 or similar fastener to thereby eliminate the need of ceramic insulators.

The snap action switch has its contact 12 positioned adjacent to the fixed contact 13 which is carried on a bridge 14 secured to the body 1, the two contacts being connected to respective terminals A and B to provide the input for the electrical wiring. Terminal A connects to the switch blade 10, while terminal B connects to the bridge 14.

The cover 15 gives access to the entire mechanism, that is, the mounting of the probe as well as the hinge member 6, the switch and the contact 12 and 13.

Temperature adjustment is accomplished by means of the temperature adjustment shaft 16 which has on its inner end a cam 17 which is seated in the recess of a protrusion 20 formed in body 1 which has a mating face within it engaging a cam face of the cam 17. The arrangement is such that when the temperature adjustment shaft 16 is rotated about its longitudinal axis, the shaft is moved longitudinally toward or away from the appropriate blade of the snap action switch. To allow correct calibration of the device the temperature adjustment shaft 16 is hollow and has within it a calibration screw 18 which passes through a threaded aperture positioned axially within the cam 17 so that screw 18 can be axially adjusted to set the operating temperature of the snap action switch independently of the temperature selection which s effected by rotation of the temperature adjustment shaft 16.

The shaft 16 is of course loaded by means of a spring washer 19 so that cam 17 remains in contact at all times with the mating face on protrusion 20 of body 1 of insulating material.

Figure 2:
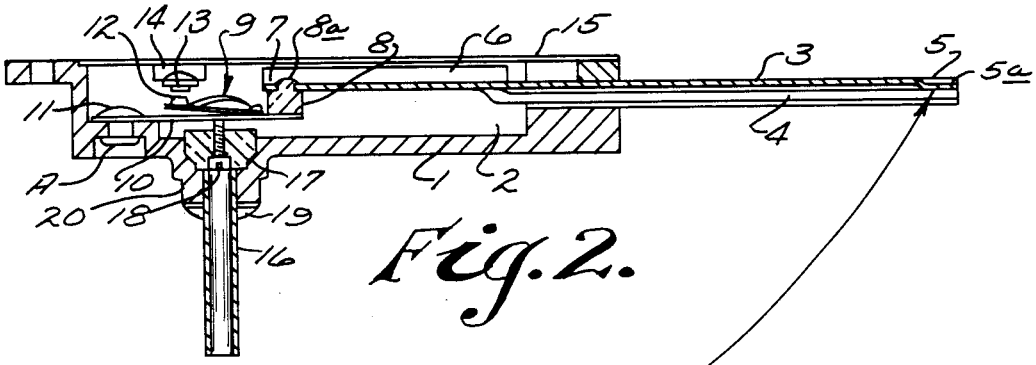
FIG. 2 is an inverted longitudinal section of FIG. 1.
Figure 2A:
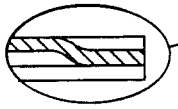
FIG. 2*a* is an enlarged partial sectional view of the channel probe and rod at their point of connection at their outer distal ends.

As mentioned supra, switch blade 10 has an end mounted on body 1 by rivet 11 to serve as a support for the switch mechanism 9. Electrically conductive support blade 10 extends from rivet 11 and forms one member of the overbalancing switch assembly 9. Blade 10 has a central tongue 24 which is integrally joined to the blade at one end but which is otherwise separated from the blade, the opposite end of the tongue being turned up to form a reaction surface or point 26. Additionally a slot 28 is formed adjacent surface 26 adapted to engage with tab 30 to be discussed below. Securely mounted, as by welding, on the support blade 10 at its free end is a switch blade 32 which projects back from the free end of the support blade towards its mounted end. Switch blade 32 has mounted on its free distal end, as by welding, a movable contact 12. The contact 12 is in electrical continuity with support blade 10 through switch blade 32 and is electrically connected to terminal A (FIGS. 1 and 2). Stationary contact 13, mounted on frame 14 is electrically connected to terminal B (FIG. 1).

The switch blade 32 is of the type which has a spring section 34 which is joined at one end to blade 32 but which is otherwise punched out and separated therefrom. The free end of section 34 is captured by reaction surface 26 and biased thereagainst to load the spring with tab 30 received in slot 28 of support blade 10. The reaction point 26 is normally in approximately the plane of switch blade 32 when no substantial force is applied through motion transfer member 8 on the ends of blades 10 and 32. Movement of end portion 18*a* of calibration screw 18, either by means of screw 18 itself or cam 17 will move reaction point 26 out of the plane of switch blade 10 to adjust the temperature at which the switch will actuate.

Figure 6:
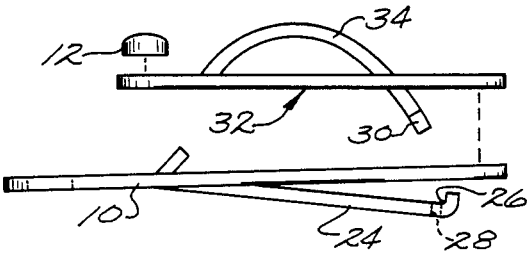
FIG. 6 is a blown apart front elevation of the snap acting mechanism of the switch.
Figure 7:
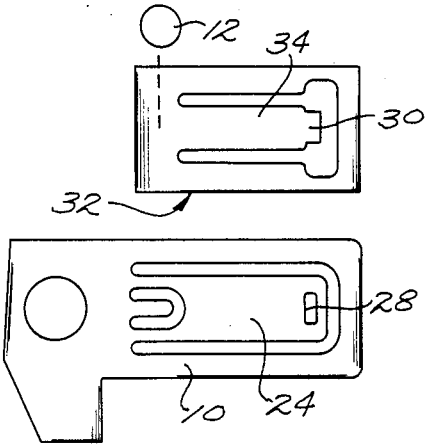
FIG. 7 is a top plan view of the FIG. 6 components.
Figure 8:
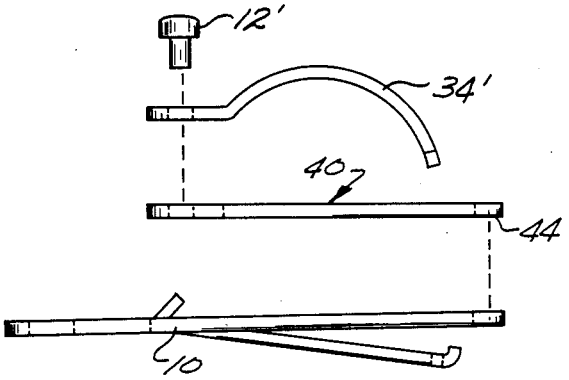
FIG. 8 is a blown apart view similar to FIG. 6 of a modified snap acting switch mechanism.
Figure 9:
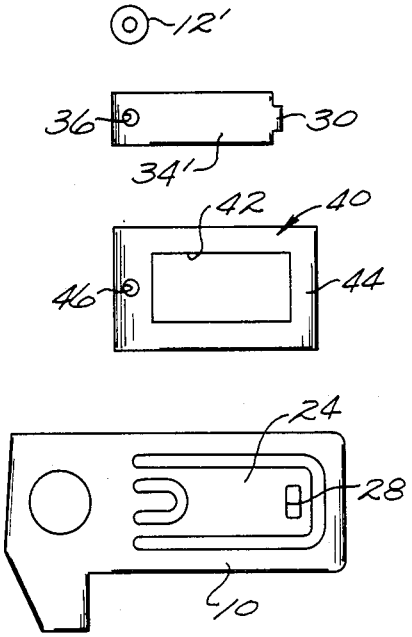
FIG. 9 is a top plan view similar to FIG. 7 of the FIG. 8 components.

With particular reference to FIGS. 8 and 9 a modified form of the switch is shown. Support blade 10 is identical to that shown in FIGS. 6 and 7 however spring element 34' is formed as a discrete element in order to optimize performance while at the same time lowering material cost. A conductive plate 40 having a central opening 42 has one end 44 joined to support blade 10, as by welding, and has a rivet receiving aperture 46 at an opposite end. Spring member 34' has tab 30 at one end and a rivet receiving aperture 36 at an opposite end. Movable contact 12' is formed as a rivet and has a cylindrical shank portion which is received through aperture 36, 46 and headed over to electrically join the contact to plate 40 and mechanically affix one end of the spring member to plate 40. Thus spring member 34', which serves as a highly stressed element, can be formed of optimum spring material, such as 17/7 PH stainless steel without regard to its electrical conductivity while plate 40 can be formed of material having good electrical conductivity. Another advantage this modification provides is that of minimizing the cost of material, that is, since good spring material is expensive relative to conventional electrically conductive material only that which is actually used as a spring is formed of the more expensive material.

It will be appreciated that, if desired, the conductive plate 40 could be formed integrally with support member 10 and still obtain the benefit of the discrete spring member.

From the foregoing it will be realized that a simple and effective device results in that the body 1 of insulating material carries the mechanism within a cavity or hollow which has a simple plate like cover which while protecting the mechanism offers ready inspection, the body being a molding arranged to support all of the components and because the body is formed of insulating material the components which require to be electrically insulated do not need special insulating means but can be attached directly to the body.

The probe itself is highly effective in that it is an open channel with substantial heat receiving area to ensure quick and accurate expansion in accordance with temperature conditions. This channel is readily formed by pressing or the like and eliminates the difficult task of forming a hollow expansion tube with an invar or similar rod inside of it to form the differential temperature means. The probe carrying the hinge member, the free end of which moves to actuate the snap action switch, is simply supported from the body of insulating material. The temperature setting is effected by the temperature adjustment shaft 16 which itself is directly supported in the protrusion 20 of the body of insulating material and is provided with calibration means which allow the exact temperature conditions to be selected independently of the temperature selection effected by turning a knob or the like on the temperature adjustment shaft.

Basically the invention thus comprises an adjustable thermostat comprising a body carrying at one end a probe and within it a snap action switch together with coupling means between the probe and the snap action switch which allow temperature conditions to actuate the snap action switch to make or break a circuit through electrical contacts associated one with a snap action switch and the other with the body, characterized in that the body 1 is formed of an insulating material and directly supports the member 3-4-6 of the probe and the snap action switch 9 and the temperature adjustment means 16-17-18 associated with the snap action switch 9 whereby a simple mechanism results with ease of manufacture and assembly in that the relevant members of the adjustable temperature thermostat are all simplified both in construction and mounting within the body.

The probe assembly can be grounded by the addition of a spring clip attached by a rivet 22 that hold the channel/rod/hinge 3-4-6 to the body 1 or by a stripe of conductive paint applied to the body to connect the channel/rod/hinge 3-4-6 to an external ground location or attachment on body 1.

What is claimed is:

1. A thermostatic switch comprising a body of electrically insulating material formed with a cavity having an open end, a support blade having a fixed end cantilever mounted on the body with a movable end extending into the cavity, a temperature sensing means mounted to deflect the movable end of the support blade in response to temperature change, a switch blade which has a first end secured to the movable end of the support blade for movement with the movable end of the support blade, a stationary contact mounted in the body the switch blade having a movable contact at an opposite end thereof movable between positions in and out of engagement with the stationary contact, the switch blade having a tension member intermediate the ends of the switch blade, and adjustable reaction point means engaging the tension member on the switch blade at one side of a plane in which the switch blade lies for holding the movable contact in one of said contact positions, the reaction point means being adjustable in position through the said plane to the opposite side of said plane to overbalance the switch blade and move the movable contact to the other of said contact positions with snap action, the adjustable reaction point means including an aperture formed in the body aligned with the support blade, an elongated member received in the aperture, the member being rotatable and slidable toward and away from the support blade through the aperture, a cam adjustment comprising a cam surface formed in the body adjacent to and circumscribing the aperture, the elongated member having a surface engageable with the cam surface and means to bias the said surface of the elongated member into continuous engagement with the cam surface whereby rotation of the elongated member in opposite directions causes sliding movement of the elongated member toward and away from the support blade.

2. A thermostatic switch according to claim 1 in which the elongated member has a longitudinal axis and further including a threaded bore formed in an end portion of the elongated member, the threaded bore having a longitudinal axis which is coincident with the axis of the elongated member and a threaded member is received in the bore and is adapted to extend beyond the elongated member to provide an adjustment which is independent of the cam adjustment.

3. A thermostatic switch according to claim 1 in which the temperature sensing means comprises an elongated channel mounted on the body and extending therefrom, the channel having a first coefficient of expansion and an elongated rod formed of a second coefficient of expansion different from the first, the rod extending parallel to the channel and having a free distal end fixedly attached to a free distal end of the channel, the channel having an integrally formed lever and an integrally formed hinge intermediate the channel and lever, the lever and hinge disposed in the cavity with the lever having a distal end portion aligned with the movable end of the support blade, the rod having an end opposite the free distal end which is fixedly attached to the lever.

4. A thermostatic switch according to claim 3 in which the distal end portion of the lever is formed with a slot extending along a portion of the length of the lever and formed with a cut out portion intermediate the end of the slot and the distal end and further including a motion transfer member having a shank-like protrusion, the protrusion having a diameter slightly greater than the diameter of the cut out portion, the protrusion forced through the cut out portion to mount the motion transfer member to the lever.

5. A thermostatic switch according to claim 3 in which the channel has a neutral axis and a portion of the channel at the free distal end thereof is bent to provide a platform which is aligned with the neutral axis, the distal free end of the rod fixedly attached to the distal free end of the channel on the said platform.

6. A thermostatic switch comprising a body formed with a cavity, an electrical switch having contacts which are movable relative to one another into and out of engagement mounted in the cavity, the switch including a movable member operatively connected to a temperature sensing means, the temperature sensing means comprises an elongated channel mounted on the body and extending therefrom, the channel having a first coefficient of expansion and an elongated rod formed of a second coefficient of expansion different from the first, the rod extending parallel to the channel and having a free distal end fixedly attached to a free distal end of the channel, the channel having an integrally formed lever and an integrally formed hinge intermediate the channel and lever, the lever and hinge disposed in the cavity with the lever having a distal end portion aligned with the movable member, the rod having an end opposite the free distal end which is fixedly attached to the lever.

7. A thermostatic switch according to claim 6 in which the distal end portion of the lever is formed with a slot extending along a portion of the length of the lever and formed with a cut out portion intermediate the end of the slot and the distal end and further including a motion transfer member having a shank-like protrusion, the protrusion having a diameter slightly greater than the diameter of the cut out portion, the protrusion forced through the cut out portion to mount the motion transfer member to the lever.

8. A thermostatic switch according to claim 6 in which the channel has a neutral axis and a portion of the channel at the free distal end thereof is bent to provide a platform which is aligned with the neutral axis, the distal free end of the rod fixedly attached to the distal free end of the channel on the said platform.

9. An electrical switch comprising an electrically conductive support blade having a first end cantilever mounted on a support and having an opposite distal end, an electrically conductive switch blade being generally rectangular in plan view and having a centrally disposed cut out section, the switch blade having a first end fixedly connected to the opposite distal end of the support blade and extending generally back toward the first end of the support blade, a stationary contact mounted on the support, the switch blade having a movable contact at an opposite end relative to the first end of the switch blade movable between positions in and out of engagement with the stationary contact, a discrete tensioning member having first and second opposite ends formed of material having optimum spring characteristics, the first end of the tensioning member fixedly attached to switch blade at said opposite end, the second end of the tensioning member captured on the support blade at a reaction point, the tensioning member placing a force on the switch blade tending to cause the contacts to move into and out of engagement dependent on the position of the reaction point.

10. An electrical switch according to claim 9 in which an aperture is formed in the switch blade at the said opposite end thereof and in the tensioning member at its first end and the movable contact has a rivet shank received in the apertures and headed over to physically affix them together with the electrical contact in electrical engagement with the switch blade.

11. An electrical switch comprising a body of electrically insulating material formed with a cavity having an open end, a support blade having a fixed end cantilever mounted on the body with a movable end extending into the cavity, a temperature sensing means mounted to deflect the movable end of the support blade in response to temperature change, a switch blade which has a first end secured to the movable end of the support blade for movement with the movable end of the support blade, a stationary contact mounted in the body, the switch blade having a movable contact at an opposite end thereof movable between positions in and out of engagement with the stationary contact, the switch blade having a tension member intermediate the ends of the switch blade, the tension member being a discrete element formed of material having optimum spring characteristic and adjustable reaction point means engaging the tension member on the switch blade at one side of a plane in which the switch blade lies for holding the movable contact in one of said contact positions, the reaction point means being adjustable in position through the said plane to the opposite side of said plane to overbalance the switch blade and move the movable contact to the other of said contact positions with snap action.

* * * * *